US005281977A

United States Patent [19]

Kurita et al.

[11] Patent Number: 5,281,977

[45] Date of Patent: Jan. 25, 1994

[54] THERMAL TRANSFER RECORDING APPARATUS

[75] Inventors: Shigeharu Kurita, Kawasaki; Toshiyuki Hayashi, Yokohama; Toshiyuki Takano; Masahiro Funakoshi, both of Kawasaki, Japan

[73] Assignee: Canon Kabushiki Kaisha, Tokyo, Japan

[21] Appl. No.: 836,516

[22] Filed: Feb. 18, 1992

[30] Foreign Application Priority Data

Feb. 18, 1991 [JP] Japan ..... 3-23063
Feb. 13, 1992 [JP] Japan ..... 4-26422

[51] Int. Cl.[5] ..... B41J 17/10

[52] U.S. Cl. ..... 346/76 PH; 358/296; 400/235; 400/235.1; 400/236; 400/224.1; 400/224.2; 400/232

[58] Field of Search ..... 400/235, 235.1, 236, 400/236.1, 236.2, 224.1, 224.2, 232, 225, 227, 223, 224; 346/76 PH; 358/296

[56] References Cited

U.S. PATENT DOCUMENTS 5,041,845 8/1991 Ohkubo et al. ..... 346/24

FOREIGN PATENT DOCUMENTS 0363962 4/1990 European Pat. Off. ..... 400/249
0368325 5/1990 European Pat. Off. ..... 400/249
0201686 11/1983 Japan .
0042087 3/1985 Japan ..... 400/232
0135773 6/1986 Japan ..... 346/76 PH
2161756 1/1986 United Kingdom ..... 400/232

OTHER PUBLICATIONS

Sweet et al., "Reduced Consumption of Ribbon on an Impact Printer", IBM Bulletin, vol. 23, No. 8, Jan. 1981, p. 3506.

*Primary Examiner*—Benjamin R. Fuller
*Assistant Examiner*—Huan Tran
*Attorney, Agent, or Firm*—Fitzpatrick, Cella, Harper & Scinto

[57] ABSTRACT

There is disclosed a thermal transfer recording apparatus capable of regulating the amount of transport of ink sheet according to the selected recording sheet, thereby maintaining uniform quality of image recording. The apparatus is provided with an ink sheet transporting mechanism, a recording sheet transporting mechanism, a thermal recording head, a selector for selecting the recording sheet, and a controller for regulating the transport amount of ink sheet according to the selected recording sheet. For a recording sheet with rougher recording surface, the transport amount of ink sheet is so regulated to increase the amount of transferred ink, thereby better covering the rougher recording surface.

10 Claims, 7 Drawing Sheets

THERMAL TRANSFER RECORDING APPARATUS

BACKGROUND OF THE INVENTION

1. Field of the Invention

The preset invention relates to a thermal transfer recording apparatus for image recording on a recording medium by ink transfer thereto from an ink sheet, and a facsimile apparatus utilizing said recording apparatus.

2. Related Background Art

In general, the thermal transfer recording apparatus effects image recording by employing an ink sheet obtained by coating a substrate film with thermally fusible ink, and selectively heating said ink sheet with a thermal recording head in response to image signals thereby transferring thus fused ink onto the recording sheet. Since such ink sheet is generally so-called one-time ink sheet in which the ink is completely transferred to the recording sheet in one recording, it is necessary, after the recording of a character or a line, to advance the ink sheet by a length corresponding to the recorded length, thereby securely bring an unused portion of the ink sheet to the position of next recording. This results in an increased amount of use of the ink sheet, and, for this reason the running cost of the thermal transfer recording apparatus has been significantly higher than that of the thermal recording apparatus.

In order to overcome this drawback, there is already proposed a thermal transfer recording apparatus employing so-called multi-print method, employing so-called multi-print ink sheet capable of image recordings of plural times in a same portion, and advancing the recording sheet and the ink sheet with a speed difference in such a manner that, during a recording of a length l on the recording sheet, the ink sheet is advanced by a smaller length $l/n$ ($n>1$).

However, such thermal transfer recording apparatus has been associated with a drawback that the quality of recorded image fluctuates according to the kind of recording medium, because, in energizing the motor for ink sheet advancement plural times, the number of pulses for said energization is determined not in consideration of the kind of recording medium. For example, in a recording medium with a relatively rough surface such as recycled paper, paper fibers protrude on the sheet surface, thereby forming a plurality of small irregularities. Therefore, when the ink is transferred onto the sheet surface, the peak portions of such small irregularities are not covered by ink, or, even if they are covered by ink, the ink will be rubbed off by the friction between the ink sheet and the recording sheet, thereby exposing the whiter peak portions and generating unevenness in density.

SUMMARY OF THE INVENTION

This invention, reached in consideration of the above-mentioned drawbacks in the prior art, is based on a new idea that has not been anticipated in the past.

An object of the present invention is to resolve the technical drawbacks in the above-mentioned prior art and to provide a thermal transfer recording apparatus capable of controlling the transportation of ink sheet in consideration of the kind of recording medium thereby attaining uniform quality in the recorded image, a facsimile apparatus employing said thermal transfer recording apparatus, and a thermal transfer recording method therefor.

Another object of the present invention is to provide a thermal transfer recording apparatus for image recording by ink transfer from an ink sheet onto a recording medium, comprising:

ink sheet transport means for transporting said ink sheet;

recording medium transport means for transporting said recording medium;

recording means for acting on said ink sheet for forming a record on said recording medium;

selection means for selecting the kind of said recording medium; and control means for controlling the driving amount of said ink sheet transport means according to the kind of said recording medium selected by said selection means.

Still another object of the present invention is to provide a facsimile apparatus capable of image recording by ink transfer from an ink sheet onto a recording medium, comprising:

ink sheet transport means for transporting said ink sheet;

recording medium transport means for transporting said recording medium;

image signal reception means;

recording means for acting on said ink sheet for forming a record on said recording medium, based on an image signal received by said image signal reception means;

selection means for selecting the kind of said recording medium; and control means for controlling the driving amount of said ink sheet transport means, according to the kind of said recording medium selected by said selection means.

Still another object of the present invention is to provide a thermal transfer recording apparatus for image recording by ink transfer from an ink sheet onto a recording medium, comprising:

ink sheet transport means for transporting said ink sheet;

recording medium transport means for transporting said recording medium;

recording means for acting on said ink sheet for forming an image on said recording medium;

a drive amount selector switch for selecting the drive amount of said ink sheet transport means; and control means for controlling the driving amount of said ink sheet transport means, according to the driving amount selected by said drive amount selector switch.

Still another object of the present invention is to provide a facsimile apparatus for image recording by ink transfer from an ink sheet onto a recording medium, comprising:

ink sheet transport means for transporting said ink sheet;

recording medium transport means for transporting said recording medium;

image signal reception means;

recording means for acting on said ink sheet for forming an image on said recording medium, according to an image signal received by said image signal reception means;

a drive amount selector switch for selecting the driving amount of said ink sheet transport means; and control means for controlling the driving amount of said ink sheet transport means, according to the driving amount selected by said driving amount selector switch.

Still another object of the present invention is to provide a thermal transfer recording method for image recording by ink transfer from an ink sheet onto a recording medium, comprising steps of:

selecting the kind of said recording medium;

determining the amount of transport of said ink sheet according to the kind of selected recording medium; and recording an image by ink transfer from said ink sheet onto said recording medium while transferring the ink sheet with thus determined amount of transportation.

DETAILED DESCRIPTION OF THE PREFERRED EMBODIMENTS

Now the present invention will be clarified in detail by preferred embodiments shown in the attached drawings.

Figure 1:
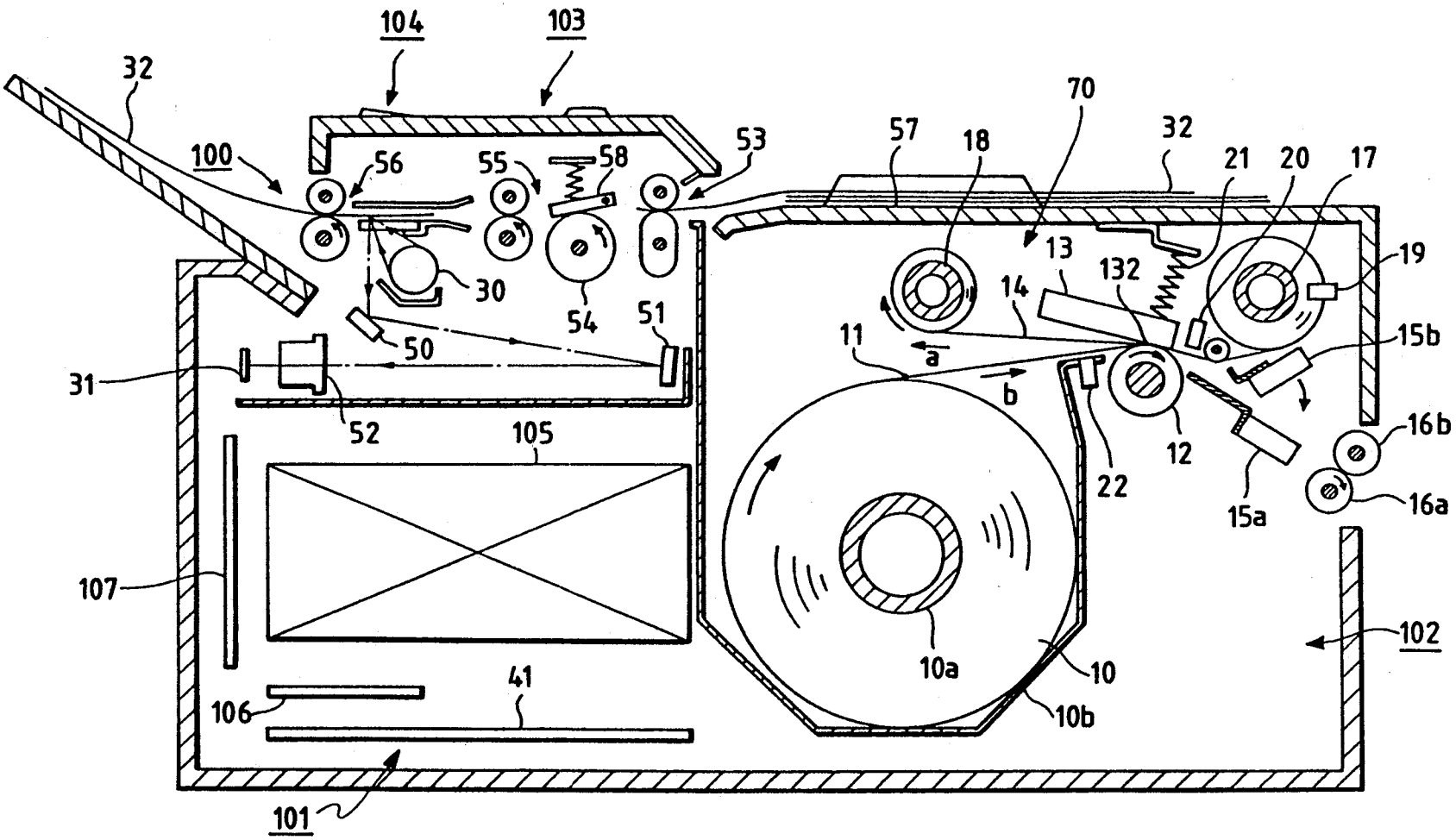
FIG. 1 is a lateral cross-sectional view of a facsimile apparatus, incorporating a thermal transfer printer constituting a representative embodiment of the present invention.

FIG. 1 is a lateral cross-sectional view of a facsimile apparatus incorporating the thermal transfer printer which constitutes a representative embodiment of the present invention.

Explanation of facsimile apparatus (FIG. 1)

The facsimile apparatus shown in FIG. 1 is provided with a reader unit 100 equipped with an original transporting motor (not shown) and a CCD image sensor, for photoelectrically reading an original image and releasing digital image signal; a control unit 101 for controlling various units of the apparatus; a recording unit 102 equipped with a thermal line head, for recording an image on a recording sheet by thermal transfer recording method; an operation unit 103 equipped with various function keys for example for start of transmission and numeral keys for entering telephone numbers; a display unit 104 for indicating various functions, status of the apparatus and the remaining amount of ink sheet; a power source unit 105 for supplying the entire apparatus with electric power; a modem board unit 106; and a NCU (network control unit) board 107. In the actual operation, the facsimile apparatus is connected with a telephone set 108 shown in FIG. 2. There is also provided a control board 41, constituting the principal part of the control unit 101 and serving to provide various units of the apparatus with control signals.

In the following there will be explained the detailed structure of the reader unit 100.

Referring to FIG. 1, a light source 30 illuminates an original 32, and the light reflected by said original 32 is guided through an optical system (mirrors 50, 51 lens 52) to a CCD sensor 31 for conversion into electrical signal. The original 32 is advanced with a speed corresponding to the reading speed thereof, by transport rollers 53–56, driven by an unrepresented motor. An original stacker 57 supports plural originals 32, which are separated and advanced one by one to the reader unit 100, by the cooperation of the transport roller 54 and a separating pressure member 58.

In the following explained is the detailed structure of the recorder unit 102, which corresponds to the thermal transfer printer.

Referring to FIG. 1, a recording sheet 11 is wound as a roll 10 on a core 10*a*. Said roll 10 is detachably and rotatably in a loading chamber 10*b* so as to supply a thermal head 13 with the recording sheet 11 by the rotation of a platen roller 12 in a direction indicated by an arrow. The platen roller 12 serves not only to advance the recording sheet 11 in the direction b but also to press an ink sheet 14 and the recording sheet 11 to heat-generating elements 132 of the thermal head 13. After image recording by the heat of said thermal head 13, the recording sheet 11 is advanced toward discharge rollers 16*a*, 16*b* by further rotation of the platen roller 12, and is cut into a page by the engagement of cutters 15*a*, 15*b* after image recording of a page.

The ink sheet 14 is wound on an ink sheet supply core 17, and is taken up in a direction a onto an ink sheet takeup core 18 driven by an ink sheet transport motor to be explained later. Said cores 17, 18 are detachably loaded in an ink sheet loading portion 70 of the apparatus. There are also provided a sensor 19 for detecting the remaining amount and transport speed of the ink sheet 14; an ink sheet sensor 20 for detecting the presence or absence of the ink sheet 14; a spring 21 for pressing the thermal head 13 against the platen roller 12 across the recording sheet 11 and the ink sheet 14; and a recording sheet sensor 22 for detecting the presence or absence thereof.

Figure 2:
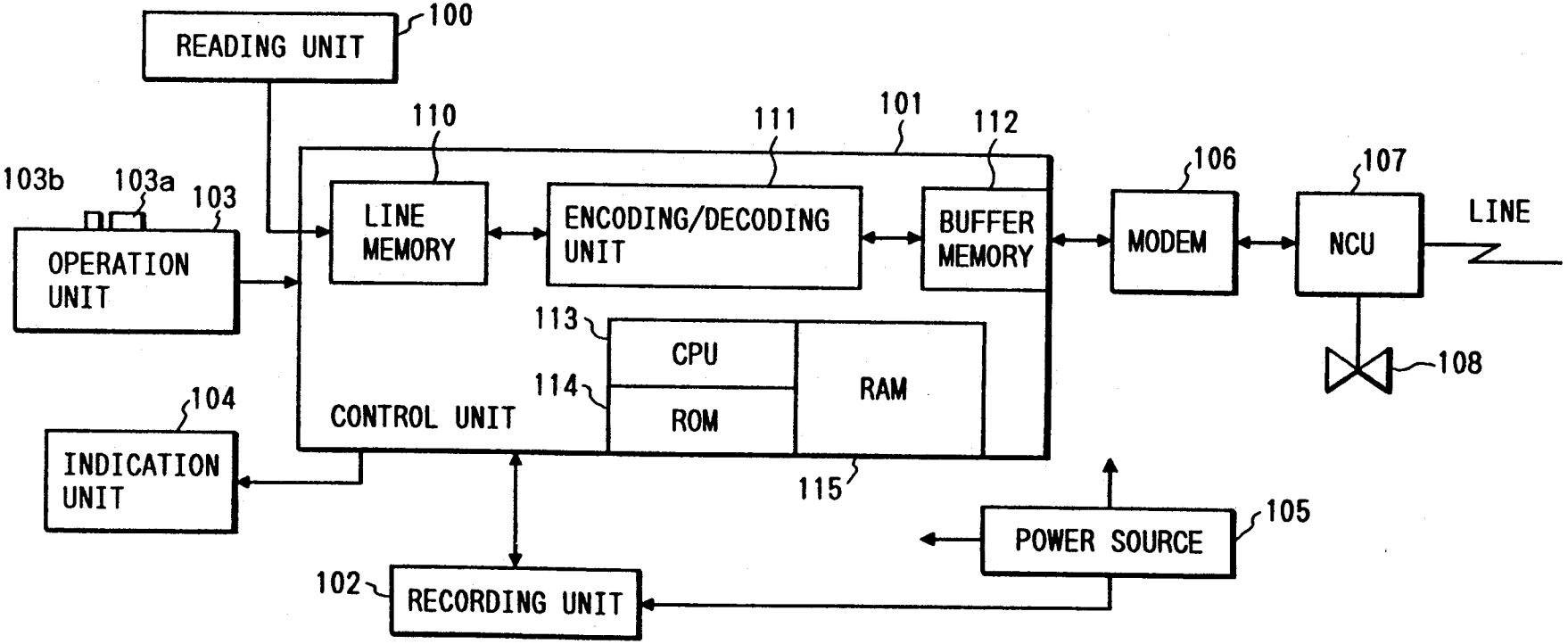
FIG. 2 is a block diagram showing the details of a control unit of the facsimile apparatus shown in FIG. 1, with relations to various units.

Explanation of control unit (FIG. 2)

FIG. 2 is a block diagram showing the detailed structure of the control unit 101 of the facsimile apparatus, incorporating the thermal transfer printer, as shown in FIG. 1, wherein same components as those in FIG. 1 are represented by same numbers and will not be explained further.

Referring to FIG. 2, a line memory 110 stores image data of a line, received from the reader unit 100 in case of original transmission or copying, or decoded image data in case of reception, and thus stored data are supplied to the recording unit 102 for image formation. An encoding/decoding unit 111 encodes the image information to be transmitted, for example by MH encoding, and decides the received encoded image data into normal image data. A buffer memory 112 serves to store encoded image data received or to be transmitted. These units of the control unit 101 are controlled by a CPU 113 composed for example of a microprocessor. The control unit 101 is further provided with a ROM 114 storing control programs and various data for the CPU 113, and a RAM 115 serving as a working area for the CPU 113.

A switch 103*a*, for indicating the kind of the ink sheet 14 used, indicates a multi-print ink sheet or an ordinary one-time ink sheet respectively when it is on or off. A switch 103b indicates the kind of recording sheet used.

A program for ink sheet transport control, to be explained later, is stored in the ROM 114. When transport control is required, the CPU 113 reads and executes said program, employing the ROM 114 and the RAM 115 as the constant storage area and the work area.

Figure 3:
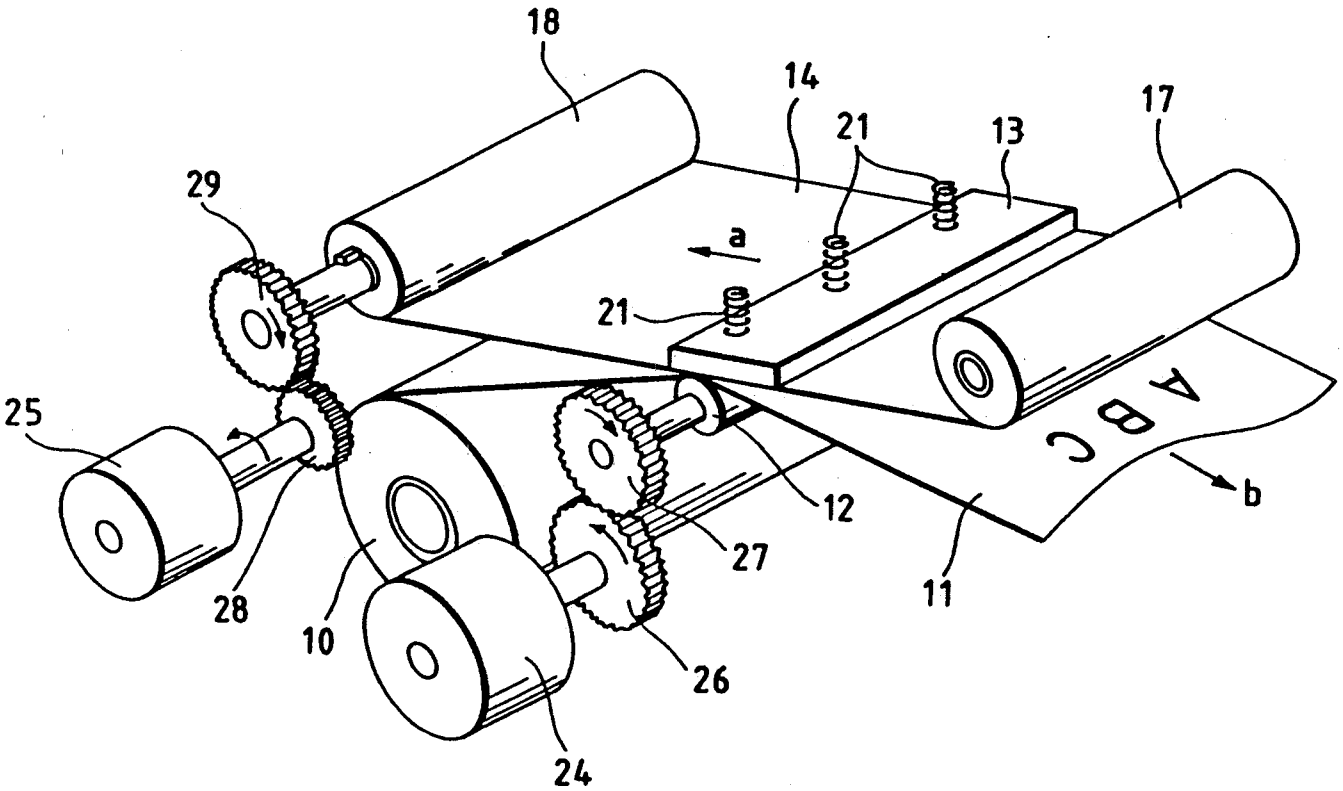
FIG. 3 is a perspective view of a transport system for the ink sheet and the recording sheet, in the facsimile apparatus shown in FIG. 1.

Explanation of transport mechanism for ink sheet and recording sheet (FIG. 3)

FIG. 3 shows the details of the transport mechanism for the ink sheet 14 and the recording sheet 11, for the facsimile apparatus, incorporating the thermal transfer printer, shown in FIG. 1, wherein same components as those in FIG. 1 are represented by same numbers and will not be explained further.

As shown in FIG. 3, there are provided a recording sheet transport motor 24 for driving the platen roller 12, thereby advancing the recording sheet 11 in a direction b opposite to a; an ink sheet transport motor 25 for transporting the ink sheet 14 in the direction b; gears 26, 27 for transmitting the rotation of the recording sheet transport motor 24 to the platen roller 12; and gears 28, 29 for transmitting the rotation of the ink sheet transport motor 25 to the ink sheet takeup roller 18. Said motors 24, 25 are both composed of stepping motors.

Explanation of value n (ratio of length of transport of recording sheet to that of ink sheet)

It is assumed that the recording sheet 11 is transported by a line (1/15.4 mm in the present embodiment) in the direction b, by the rotation of the platen roller 12, induced by the rotation of the motor 24 transmitted through the gears 26, 27. At the same time activated is the ink sheet transport motor 25, of which rotation is transmitted through the gears 28, 29, whereby the ink sheet 14 is advanced by 1/n lines (1/15.4 n mm) in the direction a, by feeding from the feed roll 17 and winding by the takeup roll 18.

The angle $\theta_1$ of rotation of the ink sheet takeup roller 18, when the ink sheet 14 is wound thereon by 1/n lines, is represented by:

$$\theta_1=(1/15.4\ n)/(D/2)\cdot(180/\pi)\ \text{(degrees)} \quad (1)$$

wherein D is the diameter of roller 18.

On the other hand, the ink sheet transport motor 25 is assumed to be operated in 1-2 phase energization with a basic stepping angle of $\theta_s$, namely a half-step drive with a minimum stepping angle $\theta_s/2$. Thus, the rotational angle $\theta_2$ of the takeup roller 18 when the ink sheet 14 is wound thereon in response to the advancement of the recording sheet 11 by a line can be represented as follows:

$$\theta_2=(\theta_s/2)\cdot(1/i_I)\cdot N_I \quad (2)$$

wherein $N_I$ is the number of phase energizations or the number of pulses for the ink sheet transport motor 25 corresponding to the advancement of the recording sheet 11 by a line, and $i_I$ is the reduction ratio of the gears 28, 29.

Since $\theta_1$ and $\theta_2$ are mutually equal, the value n can be defined as follows from the equations (1) and (2):

$$n=(720\ i_I/15.4\ \pi N_I\theta_s)\cdot(1/D) \quad (3).$$

The equation (3) indicates that, for a given number $N_I$ of energizations of the ink sheet transport motor 25, the value n varies depending on the diameter D of the ink sheet takeup roller 18, whereby the quality of recorded image also varies. Consequently the quality of the recorded image can be stabilized by setting the number $N_I$ of energizations of the ink sheet transport motor 25 at several levels according to the amount of use of the recording sheet 11, thereby maintaining the value n stabler.

Also according to the present invention, the number $N_I$ is varied according to the kind of the recording medium, thereby controlling the level of the value n.

In the following there will be explained two embodiments of ink sheet transport control according to the kind of recording medium, in the above-explained facsimile apparatus incorporating the thermal transfer printer. In the following description there will be employed reference numbers shown in FIGS. 1 to 3, unless otherwise specified.

Figure 4:
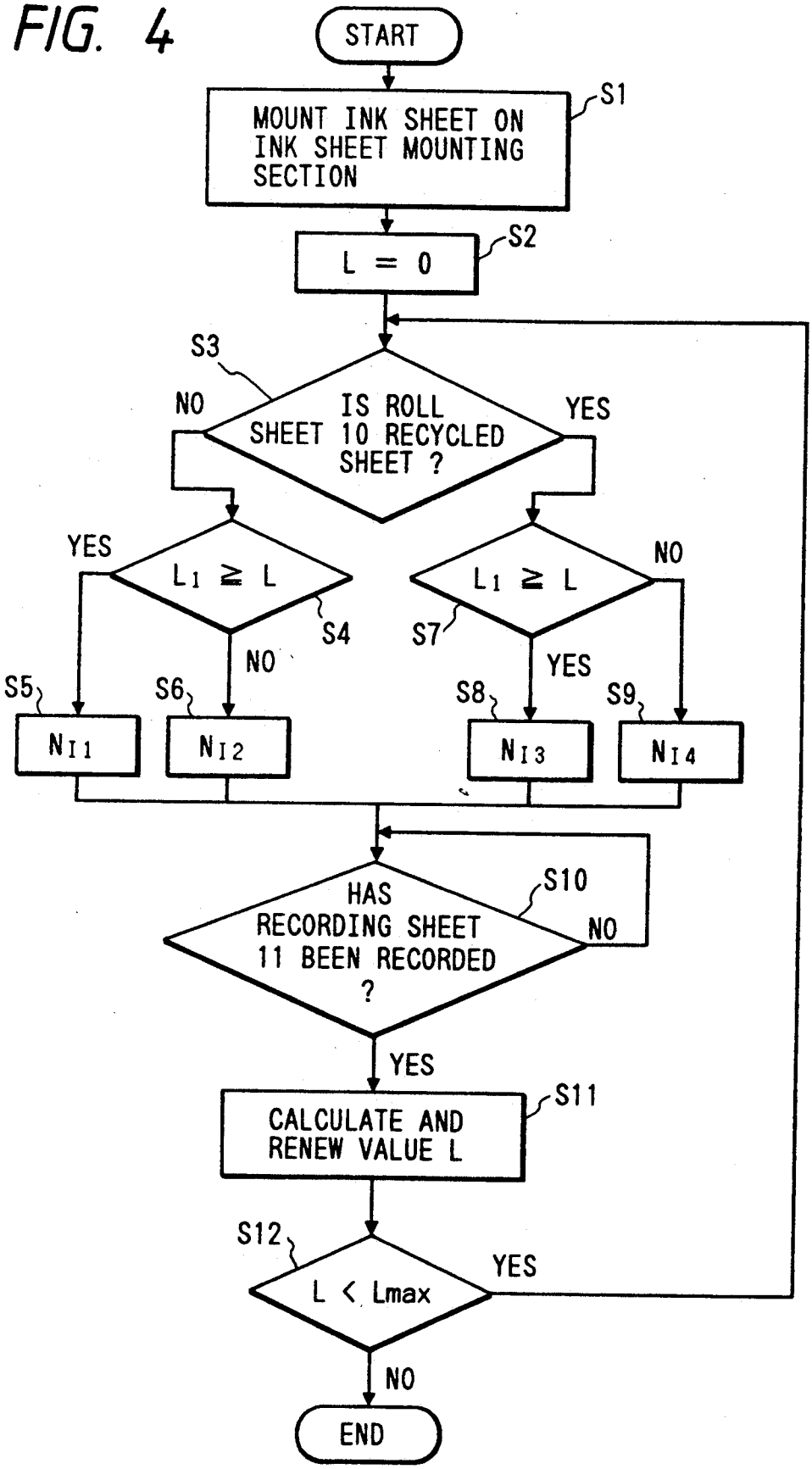
FIG. 4 is a flow chart of the control sequence for ink sheet transportation in a first embodiment.

1st embodiment of ink sheet transport control (FIG. 4)

The present embodiment executes transport control of a roll of ink sheet 14, as will be explained with reference to FIG. 4. In this embodiment, the number of phase energizations (pulses) of the ink sheet transport motor 25 is set in one of four levels $N_{I1}$, $N_{I2}$, $N_{I3}$ and $N_{I4}$ ($N_{I1}>N_{I2}$, $N_{I3}>N_{I4}$, $N_{I3}>N_{I1}$, $N_{I4}>N_{I2}$).

At first a step S1 loads the unused ink sheet 14 in the loading portion 70. Then a step S2 loads the rolled sheet 10, and sets the total transport length of ink sheet at "0" since no image recording has been conducted in this state. A next step S3 discriminates the kind of rolled sheet 10, indicated by the user through the operation unit 103. In the present embodiment there can be used ordinary recording paper or recycled recording paper, which can be indicated respectively by "off" or "on" state of the selector switch 103b of the operation unit 103. The sequence proceeds to a step S4 or S7 respectively if the step S3 identifies the ordinary recording sheet (switch 103b being off) or the recycled recording sheet (switch 103b being on).

In case the ordinary recording sheet is in use, a next step S4 discriminates whether the total transport length L of the ink sheet is not in excess of a threshold value L1. In case $L1 \geqq L$, the sequence proceeds to a step S5 for driving the ink sheet transport motor 25 $N_{I1}$ times. On the other hand, in case of $L_I<L$, the sequence proceeds to a step S6 for energizing the motor 25 with $N_{I2}$ pulses.

Said threshold value $L_1$ is for example selected as the total transport length of the ink sheet corresponding to the ink sheet takeup roll diameter equal to 31.5 mm. When $L_1 \geqq L$, namely when the amount of use of the ink sheet is not very high, the diameter of the ink sheet takeup roll is relatively small. Thus the ink sheet transport speed is relatively low, so that there is selected a condition $N_{I1}=3$. On the other hand, in case of $L_1<L$, the amount of use of the ink sheet is larger, so that the ink sheet transport speed becomes relatively large. Since the value n becomes smaller than the desired value, there is selected a condition $N_{I2}=2$, thereby reducing the amount of drive of the ink sheet transport motor 25, thereby bringing the value n closer to the desired value.

In case of using recycled recording sheet, the sequence proceeds to a step S7 for discriminating whether the total transport length L of the ink sheet is not in excess of the threshold value $L_1$. If $L_1>L$, the sequence proceeds to a step S8 for driving the ink sheet transport motor 25 with $N_{I3}$ pulses. On the other hand, if $L_1<L$, the sequence proceeds to a step S9 for driving the motor 25 with $N_{I4}$ pulses. For example there are selected conditions $N_{I3}=4$ and $N_{I4}=3$. The change in the number of energizations of the ink sheet transport motor 25 depending on the condition $L_1 \geqq L$ or $L_1>L$ is based on the same reason as in the case of using the ordinary recording sheet.

A next step S10 discriminates whether predetermined recording on the recording sheet 11 has been completed, and, after the completion of recording, a step S11 calculates the total transport length L (mm) of the ink sheet and renews the value L initialized in the step S2. The value L can be calculated from the remaining amount of ink sheet 14, detected by the ink sheet sensor 19. It may also be calculated by the equation:

$$L=\{(D/2)^2-(d/2)^2\}\cdot\pi/t$$

wherein d (mm) is the diameter of ink sheet takeup core, t (mm) is the thickness of ink sheet, and D is the diameter of ink sheet takeup roll after winding the length L.

Finally a step S12 discriminates whether the total transport length L of the ink sheet has reached the maximum transport length $L_{max}$ of a roll of the ink sheet, and, if $L<L_{max}$, the sequence returns to the step S3, but, if $L \geqq L_{max}$, the transport control for a roll of ink sheet is terminated.

Thus, according to the present embodiment, the transport of ink sheet is controlled by varying the number of energizations of the ink sheet transport motor depending on the kind of the rolled recording sheet to be employed. More specifically, if the recording surface of the sheet is relatively rough, the amount of ink sheet transport per unit time is increased to elevate the amount of transferred ink. In this manner it is rendered possible to reduce the unevenness in density, thus providing more uniform quality in the recorded image.

In the present embodiment, the recording medium is selected from the ordinary recording paper or recycled paper, but the present invention is not limited to such embodiment. For example there may be employed cloth or plastic sheet as long as ink transfer from the ink sheet is possible.

Also in the present embodiment, the kind of the recording medium is identified by the status of the selector switch 103*b* of the operation unit 103, but the present invention is not limited by such embodiment. For example, there may be provided a mechanism for identifying the kind of the recording medium by detecting a mark printed on said medium, by means of a reflective photosensor.

Also the recording sheet selector switch 103*b* of the operation unit 103 may be replaced by a driving amount selector switch, for selecting the driving amount of the ink sheet transport motor 25, and the driving amount may be selected according to the kind of the recording medium. Said driving amount selector switch may also be used, in case of printing a draft document before printing the final document, for selecting a low driving amount, thereby economizing the consumption of the ink sheet.

Furthermore, in the present embodiment, the minimum stepping angle is selected same for the recording sheet transport motor 24 and the ink sheet transport motor 25, but the present invention is not limited to such embodiment. There may be employed motors of different minimum stepping angles.

Figure 5:
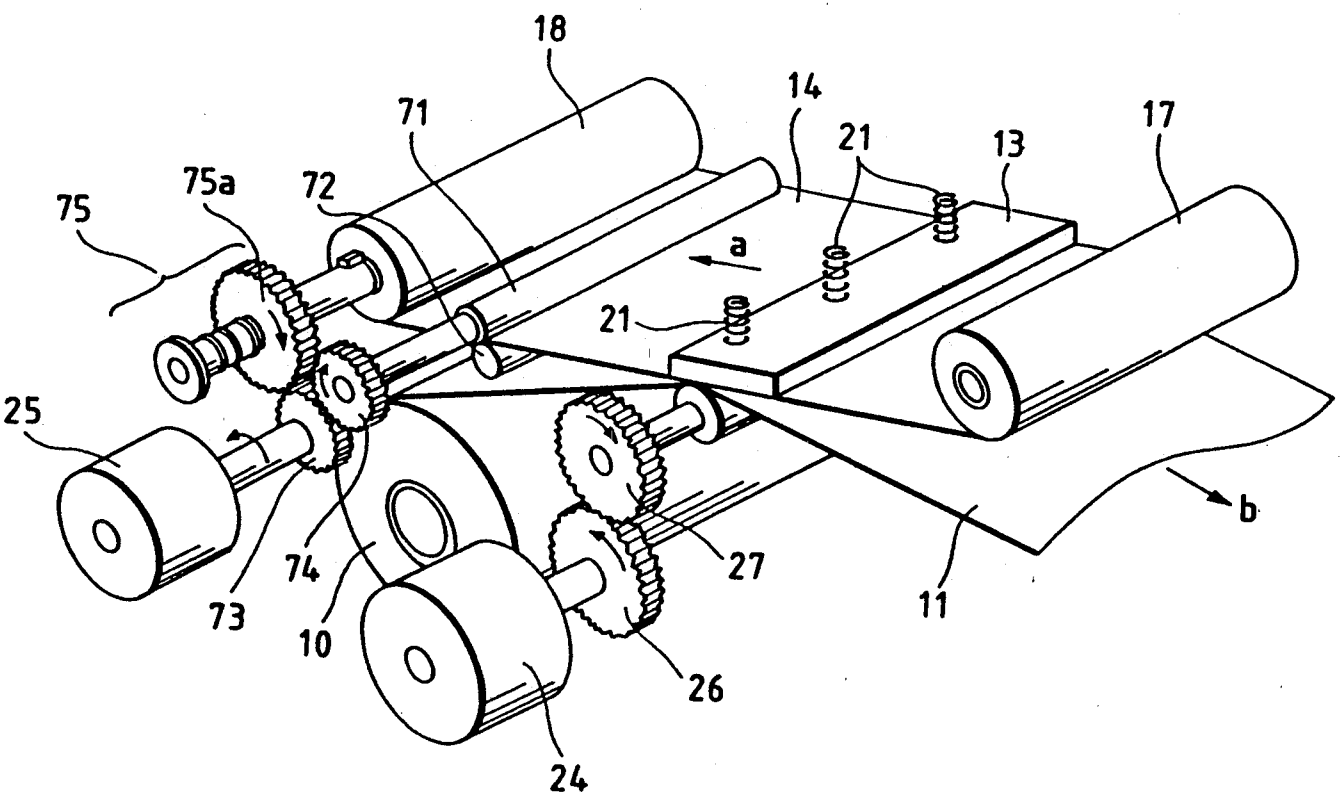
FIG. 5 is a perspective view of a transport system for the ink sheet and the recording sheet, in a facsimile apparatus shown in FIG. 1 and constituting a second embodiment.
Figure 6:
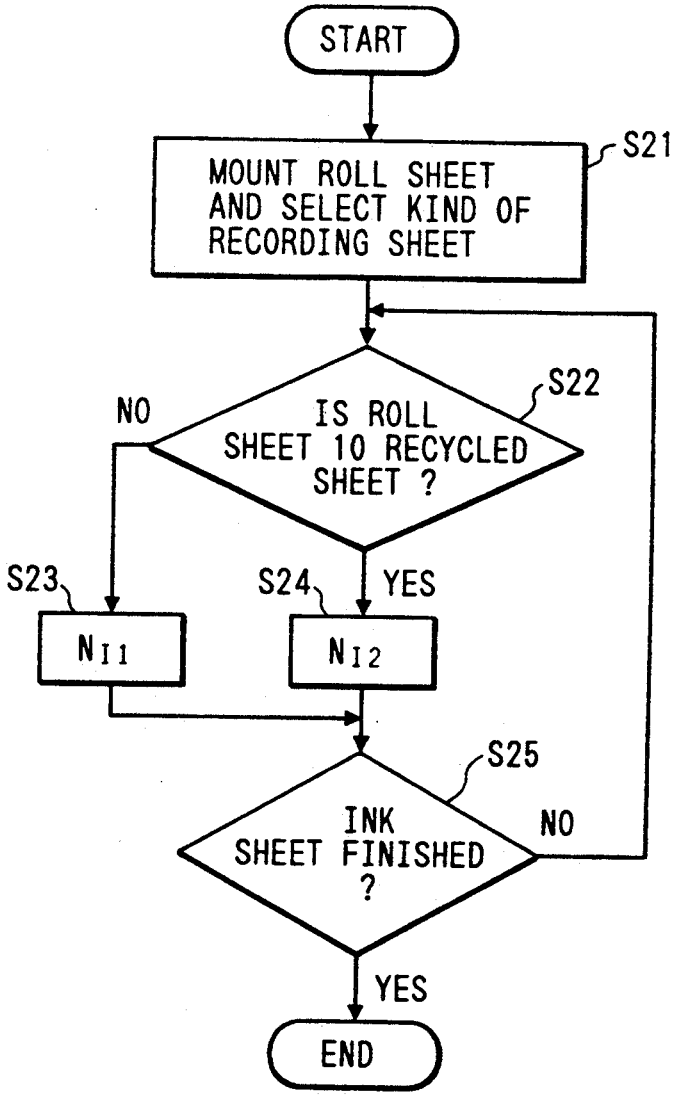
FIG. 6 is a flow chart of the control sequence for ink sheet transportation in the second embodiment.

2nd embodiment of ink sheet transport control (FIGS. 5 and 6)

In the present embodiment, the ink sheet takeup roller 18 is not directly driven, as in the 1st embodiment. Instead, the ink sheet 14 is always advanced by a constant amount by a capstan roller 71 and a pinch roller 72 in the direction a, regardless of the diameter of the takeup roller 18, as shown in FIG. 5, illustrating the details of the transport mechanism for the ink sheet 14 and the recording sheet 11. In FIG. 5, same components as those in FIG. 3 are represented by same numbers, and will not be explained further in the following.

In FIG. 5, there are provided reducing gears 73, 74 and a slip clutch unit 75. When the ink sheet transport motor 25 and the recording sheet transport motor 24 are driven, the aforementioned value n can be determined by suitable selection of the reduction ratio $i_I$ of the reducing gears 73, 74 and that $i_P$ of the reducing gears 26, 27. The gear 73 meshes with a gear 75*a* of the slip clutch 75 to take up the ink sheet 14 advanced by the capstan roller 71 and the pinch roller 72.

The ratio of the gears 74 and 75*a* is so selected that the length of the ink sheet 14 taken up on the takeup roller 18 by the rotation of the gear 75*a* is longer than that advanced by the capstan roller 71, whereby the ink sheet 14 advanced by said capstan roller 71 can be securely wound on the takeup roller 18, and the slip clutch 75 absorbs the difference between the amount of ink sheet 14 taken up on the takeup roller 18 and that advanced by the capstan roller 71. In this manner thare can be prevented variation in the transport speed of the ink sheet 14, resulting from the variation in the ink sheet take-up system.

In the following there will be explained the ink sheet transport control in a facsimile apparatus equipped with the transport mechanism shown in FIG. 5, with reference to a flow chart shown in FIG. 6. In this control sequence the number of phase energizations for the ink sheet transport motor 25 is selected either as $N_{I5}$ or $N_{I6}$ ($N_{I6}>N_{I5}$), and the selection of the recording sheet by the selector switch 103*b* of the operation unit 103 and the selectable kinds of the recording sheet are same as those in the first embodiment. Said numbers are selected, for example, as $N_{I5}=2$ and $N_{I6}=3$.

It is assumed that the apparatus is in a standby state for image recording. At first a step S21 effects loading of the rolled sheet 10, and the kind of said sheet 10 is indicated by the user, through the selector switch 103*b* of the operation unit 103. A next step S22 discriminates the kind of the loaded recording sheet, and the sequence proceeds to a step S23 or S24 respectively if the recording sheet is identified as ordinary recording sheet or recycled sheet. The step S23 drives the ink sheet transport motor 25 with energizations of $N_{I5}$ times, while the step S24 drives said motor 25 with $N_{I6}$ times. Then a step S25 discriminates whether a roll of the ink sheet has been used up, and the sequence returns to the step S22 if the ink sheet is identified still usable, but is terminated if the ink sheet is used up.

Figure 7:
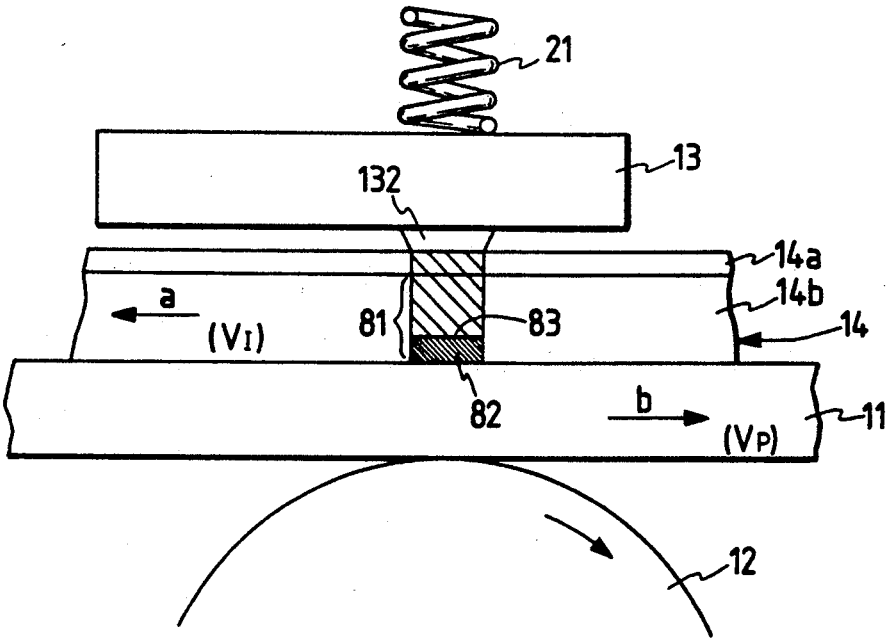
FIG. 7 is a schematic view showing the state of the recording sheet and the ink sheet at recording.

Recording principle (FIG. 7)

FIG. 7 illustrates the state of image recording when the recording sheet 11 and the ink sheet 14 are advanced in mutually opposite directions.

As shown in FIG. 7, the recording sheet 11 and the ink sheet 14 are pinched between the platen roller 12 and the thermal head 13, which is pressed against the platen roller 12 by a predetermined pressure by means of a spring 21. The recording sheet 11 is transported in a direction b with a velocity $V_P$ by means of the rotation of the platen roller 12, while the ink sheet 14 is transported in a direction a with a velocity $V_I$ by the rotation of the ink sheet transport motor 25.

When a heat generating resistor 132 of the thermal head 13 is energized by the power source unit 105, a hatched portion 81 of the ink sheet 14 is heated. The ink sheet 14 consists of a substrate film 14*a* and an ink layer 14*b* formed thereon. The ink in said heated portion 81 is fused, and a portion 82 thereof is transferred to the recording sheet 11. Said transferred portion 82 corresponds approximately to 1/n of the ink layer 81.

At said transfer, it is necessary to generate a shearing force to the ink at the boundary 83 of the ink layer 14*b*, thereby transferring the portion 82 only. Said shearing force varies according to the temperature of the ink layer and tends to become smaller as said temperature becomes higher. Thus, the shearing force in the ink layer becomes larger by shortening the heating time of the ink sheet 14. Therefore, the ink layer to be transferred can be securely peeled off from the ink sheet 14 by increasing the relative speed of the ink sheet 14 and the recording sheet 11.

Figure 8:
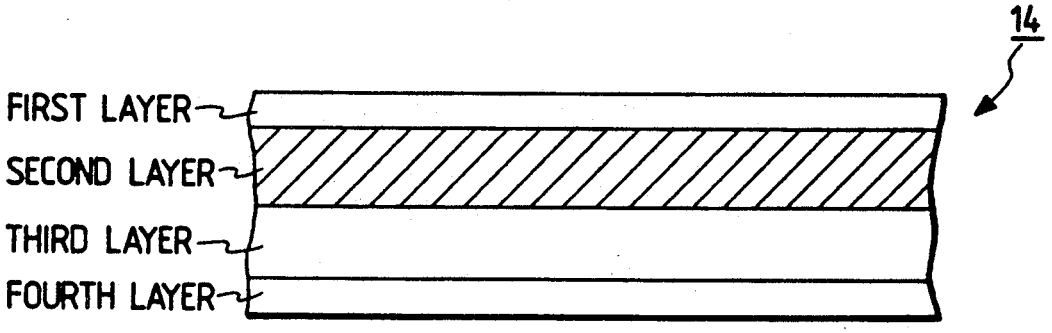
FIG. 8 is a cross-sectional view of an ink sheet.

Ink sheet structure (FIG. 8)

FIG. 8 is a cross-sectional view of the multi-print ink sheet employed in the foregoing embodiments, consisting for example of four layers.

A 2nd layer is composed of a substrate film for the ink sheet 14. In case of such multi-print ink sheet, since thermal energy is applied plural times to the same position, said substrate film is advantageously composed of a thermal resistance material such as aromatic polyamide film or condenser paper, but a conventional polyester film may also be used for this purpose. The thickness of said film is advantageously as small as possible in terms of recorded image quality, but is preferably in a range of 3 to 8 μm in consideration of the strength.

A 3rd layer consists of an ink layer, containing an amount of ink capable of transfers of n times to the recording sheet. Said ink layer is principally composed of an adhesive material such as EVA resin, a coloring material such as carbon black or negrosin dye, and a binding material such as carnauba wax or paraffin wax, so as to enable plural transfers of n times in a same position. The amount of said ink layer is preferably in a range of 4–8 g/m$^2$, but is arbitrarily selectable according to the desired sensitivity or density.

A 4th layer, constituting a top coating for preventing pressure transfer of the 3rd ink layer in an unrecorded area, is composed for example of transparent wax. Such pressure transfer takes place only in said transparent 4th layer, whereby the background smudge of the recording sheet can be prevented. A 1st layer is composed of a heat-resistant coating, for protecting the 2nd substrate film from the heat of the thermal head 13. Such heat-resistant layer is advantageous for a multi-print ink sheet which may receive thermal energy of n lines in a same position (when black information continues), but it may be employed or dispensed with arbitrarily. It is particularly benefitial for a substrate film of relatively low heat resistance, such as a polyester film.

The structure of the ink sheet 14 is not limited to the foregoing, but can be composed, for example, of a substrate layer and a porous ink-holding layer provided on one side of substrate and containing ink therein. Furthermore, it can be composed of a substrate film provided thereon with a heat-resistant ink layer of porous network structure impregnated with ink. Also the substrate film can be composed, for example, of polyamide, polyethylene, polyester, polyvinyl chloride, triacetyl cellulose, nylon or paper. Also the heat-resistant coating, which may be eventually dispensed with, can be composed for example of silicone resin, epoxy resin, fluorinated resin or nitrocellulose.

Furthermore, an ink sheet with heat-sublimable ink can be composed, for example, of a substrate such as of polyethylene terephthalate, polyethylene naphthalate or aromatic polyamide, and a coloring material layer containing dye and spacer particles composed of guanamine resin and fluorinated resin.

In the above-explained embodiment, since the ink sheet 14 is transported by a constant amount by means of a capstan roller 71 and the pinch roller 72, regardless of the diameter of the ink sheet takeup roller 18, the ink sheet transport control can be achieved in a simpler manner only in consideration of the kind of the recording sheet and without considering the change in the total transport length L of the ink sheet 14.

The heating method in the thermal transfer printer is not limited to the above-explained method employing thermal head, but can for example be a method employing laser beam heating or a method employing current supply through the ink sheet itself.

Also the foregoing embodiments have been limited to the facsimile apparatus employing thermal transfer printer, but the present invention is not limited to such embodiments and is also applicable, for example, to a word processor, a computer, a typewriter or a copying machine.

As explained in the foregoing, according to the present invention, at image recording with recording means, the amount of transport of ink sheet is controlled according to the kind of the recording medium. Thus, in case of recording on a recording medium with a relatively rough recording surface, such as recycled paper, the ink sheet transport means is so controlled as to increase the amount of transport of ink sheet per unit time. Therefore, the area of ink sheet heated by the thermal head per unit time increases, whereby increased are the amount of transferred ink and the thickness thereof. Consequently, even if the recording surface of the recording medium has small surface irregularities by the protrusion of paper fibers, the peak portions of such irregularities are covered by the ink and become no longer exposed from the ink. Thus there can be obtained sufficient image density with reduced unevenness, so that the quality of recorded image can be made uniform regardless of the kind of the recording medium.

What is claimed is:

1. A recording apparatus for image recording by ink transfer from an ink medium to a recording medium, comprising:

ink medium transport means for transporting said ink medium;

recording medium transport means for transporting said recording medium;

recording means for acting on said ink medium for forming a recording on said recording medium;

selection means for selecting a particular kind of said recording medium; and control means for controlling a driving amount of said ink medium transport means according to the particular kind of recording medium selected by said selection means, said control means being adapted to increase the driving amount of said ink medium transport means, thereby increasing a transport velocity of said ink medium when said selection means selects a first kind of said recording medium with a relative rough recording surface, and to decrease the driving amount of said ink medium transport means, thereby decreasing the transport velocity of said ink medium when said selection means selects a second kind of said recording medium of which recording surface is not rougher than that of said first kind of recording medium, and wherein the transport velocity of said ink medium by said ink medium transport means is less than a transport velocity of said recording medium by said recording medium transport means, and wherein an amount of said ink to be deposited on the recording medium of the first kind per unit time is greater than when said recording medium is of the second kind.

2. A recording apparatus according to claim 1, wherein said selection means is a recording medium selecting switch.

3. A recording apparatus according to claim 1, wherein said selection means includes a mechanism for identifying the particular kind of said recording medium.

4. A recording apparatus according to claim 1, wherein said first kind of said recording medium is recycled paper.

5. A recording apparatus for recording by ink transfer from an ink medium to a recording medium, comprising:

ink medium transport means for transporting said ink medium;

recording medium transport means for transporting said recording medium;

image signal receiving means for receiving an image signal;

recording means for acting on said ink medium for forming a record on said recording medium, based on image signal received by said image signal receiving means;

selection means for selecting a particular kind of said recording medium; and control means for controlling a driving amount of said ink medium transport means according to the particular kind of said recording medium selected by said selection means, wherein a transport velocity of said ink medium by said ink medium transport means is less than a transport velocity of said recording medium by said recording medium transport means, wherein the transport velocity of the ink medium transported by the ink medium transported means when the recording medium is of a first kind is smaller than a transport velocity of the ink medium transported by the ink medium transported means when the recording medium is of a second kind, and wherein an amount of said ink to be deposited on the recording medium of the first kind per unit time is greater than when said recording medium is of the second kind.

6. A recording apparatus according to claim 5, further comprising transmitting means for transmitting said image signal.

7. A recording apparatus according to claim 6 further comprising reading means for reading an original image.

8. A method for reducing density variation when recording on a recording medium having a rough surface on which images are recorded by ink transfer from an ink medium to the recording medium, comprising steps of:

selecting a particular kind of said recording medium;

determining an amount of transport of said ink medium according to thus selected particular kind of said recording medium; and recording an image by transferring ink from said ink medium to said recording medium, while transporting said ink medium according to thus determined amount of transport.

9. An image forming apparatus for image recording by ink transfer from an ink medium to a recording medium, comprising:

reading means for reading an original image;

ink medium transport means for transporting said ink medium;

recording medium transport means for transporting said recording medium;

recording means for acting on said ink medium for forming a recording on said recording medium;

selection means for selecting a particular kind of said recording medium; and control means for controlling a driving amount of said ink medium transport means according to the particular kind of said recording medium selected by said selection means, said control means being adapted to increase the driving amount of said ink medium transport means, thereby increasing a transport velocity of said ink medium when said selection means selects a first kind of said recording medium with a relative rough recording surface, and to decrease the driving amount of said ink medium transport means, thereby decreasing the transport velocity of said ink medium when said selection means selects a second kind of said recording medium of which recording surface is not rougher than that of said first kind of said recording medium, and wherein the transport velocity of said ink medium by said ink medium transport means is less than a transport velocity of said recording medium by said recording medium transport means, and wherein an amount of said ink to be deposited on the recording medium of the first kind per unit time is greater than when said recording medium is of the second kind.

10. A recording method for recording on a recording medium having a rough surface on which images are recorded by ink transfer from an ink medium to the recording medium, comprising steps of:

selecting a particular kind of said recording medium;

determining an amount of transport of said ink medium according to thus selected particular kind of said recording medium; and recording an image by transferring ink from said ink medium to said recording medium, while transporting said ink medium according to thus determined amount of transport.

* * * * *

UNITED STATES PATENT AND TRADEMARK OFFICE

CERTIFICATE OF CORRECTION

PATENT NO. : 5,281,977

DATED : January 25, 1994

INVENTOR(S) : SHIGEHARU KURITA, ET AL.

It is certified that error appears in the above-indentified patent and that said Letters Patent is hereby corrected as shown below:

COLUMN 4

Line 3, "51" should read --51,--.
Line 58, "decides" should read --decodes--.

COLUMN 6

Line 29, "length" should read --length L--.
Line 44, "L1." should read --$L_1$.-- and
"L1≧L," should read --$L_1 \geqq L$,--.
Line 46, "$L_I$<L," should read --$L_1 < L$,--.

COLUMN 8

Line 33, "thare" should read --there--.

COLUMN 9

Line 49, "negrosin" should read --nigrosin--.
Line 67, "benefitial" should read --beneficial--.

COLUMN 11

Line 17, "recording" should read --said recording--.
Line 60, "ported" should read --port--.
Line 63, "ported" should read --port--.

UNITED STATES PATENT AND TRADEMARK OFFICE

CERTIFICATE OF CORRECTION

PATENT NO. : 5,281,977

DATED : January 25, 1994

INVENTOR(S) : SHIGEHARU KURITA, ET AL.

It is certified that error appears in the above-indentified patent and that said Letters Patent is hereby corrected as shown below:

COLUMN 12

Line 4, "claim 6" should read --claim 6,--.
Line 11, "steps" should read --the steps--.
Line 58, "steps" should read --the steps--.

Signed and Sealed this

Thirteenth Day of September, 1994

*Attest:*

*Attesting Officer*

BRUCE LEHMAN

*Commissioner of Patents and Trademarks*